United States Patent [19]

Colombo

[11] 4,296,956

[45] Oct. 27, 1981

Best Available Copy

[54] CAM OPERATED LOCK, PARTICULARLY FOR DOORS

[75] Inventor: Angelo Colombo, Lazzate, Italy

[73] Assignee: Valli & Colombo S.p.A., Italy

[21] Appl. No.: 58,957

[22] Filed: Jul. 19, 1979

[30] Foreign Application Priority Data

Aug. 8, 1978 [IT] Italy ..... 26568 A/78
Oct. 27, 1978 [IT] Italy ..... 23159/78[U]

[51] Int. Cl.[3] ..... E05C 1/16
[52] U.S. Cl. ..... 292/169.18; 292/169
[58] Field of Search ..... 292/169.18, 169.15, 292/169, 169.14

[56] References Cited

U.S. PATENT DOCUMENTS

| | | | |
|---|---|---|---|
| 2,230,096 | 1/1941 | Voight | 292/169.18 X |
| 2,483,368 | 9/1949 | Ledin | 292/165 |
| 2,486,268 | 10/1949 | Erkkila | 292/169.18 X |
| 2,726,891 | 12/1955 | Gresham et al. | 292/169.18 X |
| 2,743,600 | 5/1956 | Heyer | 292/169.18 X |
| 2,831,336 | 4/1958 | Schlage | 292/169.18 X |
| 3,022,102 | 2/1962 | Russell et al. | 292/169.18 |
| 3,136,572 | 6/1964 | Lytle | 292/169.18 X |
| 3,896,644 | 7/1975 | Nagy et al. | 292/169 X |

*Primary Examiner*—William E. Lyddane
*Attorney, Agent, or Firm*—Steinberg & Raskin

[57] ABSTRACT

Cam operated lock comprises a latch mobile against a spring along a tubular guide. The latch is operated by way of a cam which can be rotated against a spring by a manually operating member, preferably a handle. The handle needs to be turned through only a small angle for opening the lock. The lock can be fitted to both right hand and left hand opening doors with little adaptation, and in both these positions the lock is opened by turning the handle downwards.

17 Claims, 6 Drawing Figures

CAM OPERATED LOCK, PARTICULARLY FOR DOORS

SUMMARY OF THE INVENTION

This invention relates to a door lock which can be interchanged with the so-called tubular locks operated by a knob or a similar member of circular symmetry.

Conventional tubular locks, which are mainly used in the United States, comprise a latch slidably mounted in a guide, which is made to recede (in order to open the door) by rotating a knob through a wide angle, for example 90° . These locks can also be provided with a catch mechanism which enables the latch to be blocked in the closed position when it is required to make the door unopenable from the outside.

Such locks can be fitted to doors which open in a lefthanded direction, and also to those which open in a righthanded direction.

For reasons of room appearance and personalisation, it would be advantageous to be able to use instead of the knob (which is a symmetrical body) a handle which notably has a non-symmetrical configuration, and in particular substantially radial.

However, the mechanism which enables the movement of the knob to be transmitted to the latch cannot be operated by a handle, because this would have to be moved through an excessive angle (approximately 90°), and because if it is rotated downwards on a door opening in one direction, it would have to be rotated in the opposite sense when the door opens in the reverse direction. This is obviously illogical, and for this reason up to the present time tubular locks are not operated by handles.

The main object of the present invention is therefore to provide a lock interchangeable with tubular locks of known type, and which can be operated by a handle without the latter having to move through a substantial angle to open the door, and without it having to be rotated upwards when fitted to doors opening in the opposite direction.

A further object of the present invention is to provide a lock which is reliable, simple, economical to produce and easy to install.

A further object of the present invention is to provide a lock fitted with a catch mechanism which by simply reversing two removable parts can always be operated from the inside, independently of the direction of opening of the door on which the lock is installed.

A further object of the invention is to provide a lock fitted with a catch mechanism which can be unblocked from the outside in case of emergency.

These and further objects which will be more apparent from the detailed description given hereinafter are attained by a lock essentially comprising a latch mobile against a spring along an at least approximately tubular guide, and provided with an end which can be coupled to an appendix of a slide guided in a member, and on which there acts a cam mounted to rotate in said member against a spring and arranged to be made torsionally rigid with at least one manually operating member such as, preferably, a handle.

The invention will be more apparent from the detailed description given hereinafter by way of non-limiting example, with reference to the accompanying drawing in which.

Figure 1:
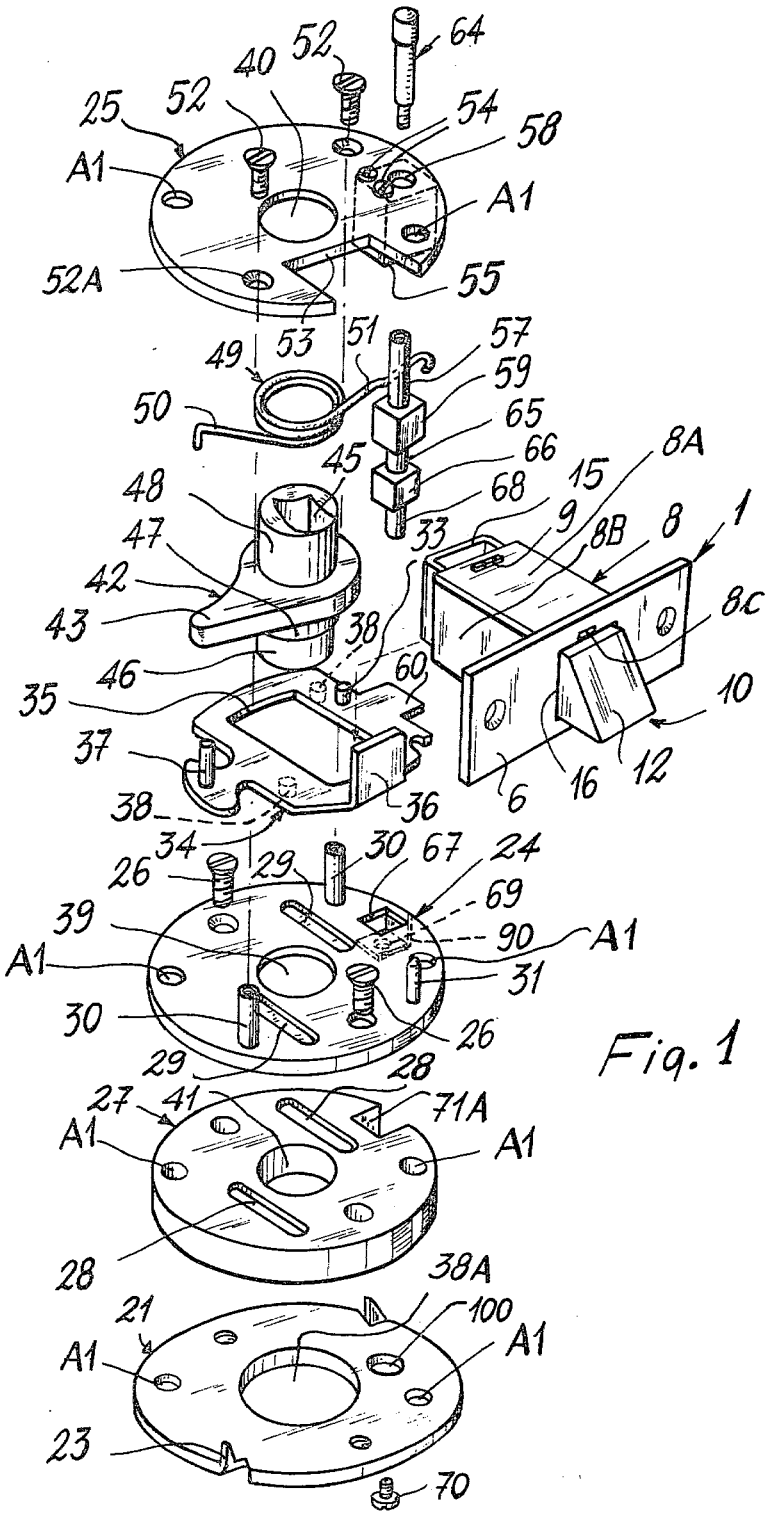
FIG. 1 is an exploded view of the lock.
Figure 5:
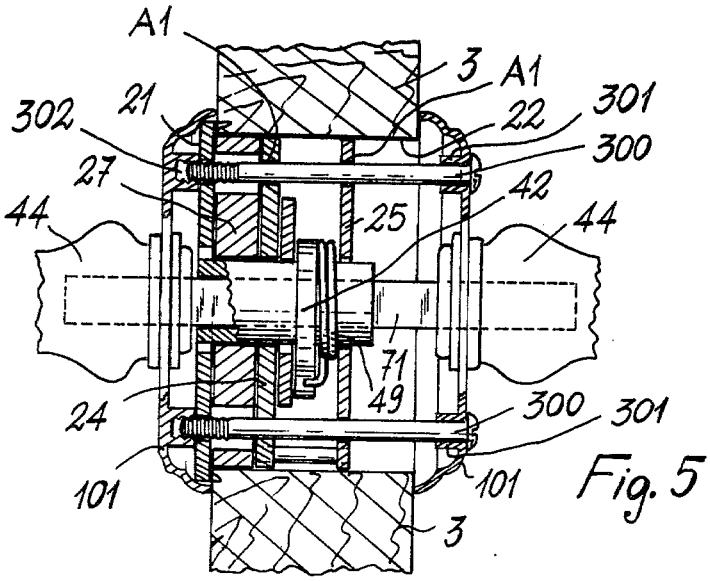
FIG. 5 is a section on the line V—V of FIG. 2.

With reference to FIGS. 1 and 5, the lock comprises two units indicated overall by 1 and 2 respectively. The unit 1 relates to the latch, and the unit 2 contains both the catch mechanism and the members which transmit movement to the latch.

The unit 1 is intended to be fixed into the depth of a door 3, which for this purpose comprises a suitable bore 4. The unit 1 is fixed to the door by screws (not shown) mounted through the holes 5 in a plate 6. The bent lugs 7 of a tubular guide of rectangular cross-section are fixed to the plate 6 by rivets (not shown), this tubular guide being intended for insertion into the said bore 4.

The tubular guide 8 is formed from a part 8B of U cross-section, and a plate 8A which closes the upper open side of the U.

The base side of the U is extended by a portion of smaller width, indicated by 9, which is bent at a right angle, its free end, which is of still smaller width, projects beyond a slot in the cover 8A (see FIG. 1). This free end is mechanically deformed so as to make the cover 8A rigid with the part 8B of the guide 8. To complete the fixing of the cover 8A, the latter comprises a tooth (not shown) which becomes disposed in a notch 8C present in the periphery of the aperture 16 provided in the plate 6, and from which the head 12 of a latch 10 projects. The latch 10 is formed from the head 12, which is provided with a bevelled face, and a fork 13, the free ends of which are fixed, for example by welding, to two opposing sides of the head 12. The two arms of the fork 13 pass through the slots 14 left free between the bent portion 9 and the adjacent sides of the part 8B of the guide 8. The transverse portion 15 of this fork is situated outside the guide 8, and by colliding against the portion 9 limits the exit of the head 12 from the aperture 16. A compression spring 11 disposed in the guide 8, between the head 12 and the bent portion 9, tends to urge the head 12 out of the aperture 16. The cover 8A is obviously fixed after the latch 10 and spring 11 have been inserted into the part 8B of the guide 8.

To keep the door 3 closed, the head 12 penetrates into the aperture 18 in a plate 19 fixed to the door post 20.

The unit 2 is mounted in a circular bore 22 provided transversely in the door 3, and into which the bore 4 opens radially. When the two units 1 and 2 are coupled together (see FIG. 2), the end of the fork 13 (where the transverse portion 15 is present) penetrates into the bore 22.

The unit 2 comprises a circular end plate 21 having a greater diameter than the diameter of the bore 22. This plate comprises substantially frontal peripheral teeth 23 (constructed by cutting and bending). By exerting a suitable pressure or impact on the plate 21 (after having inserted the rest of the unit 2 into the bore 22), the teeth 23 penetrate into the material of the door, so preventing rotation of the unit 2.

The unit 2 also comprises two other substantially circular plates 24, 25, of smaller diameter so that they can be inserted into the bore 22. The plates 21, 24 and 25 together comprise a housing assembly for the catch mechanism and the members which transmit motion to the latch. The plate 24 is fixed by screws 26 to the plate 21 by way of a disc 27, preferably formed of plastic, which acts as a spacer. By replacing the disc 27 with another of different thickness, the lock can be adapted to doors of different thicknesses.

The disc 27 comprises a pair of parallel grooves 28 which coincide with a pair of guide slots 29 in the plate 24.

Bored and threaded stop columns 30 are fixed on the plate 24 in any known manner at diametrically opposite points. On this plate there is also fixed a pin 31 which holds the end of a tension spring 32 (FIG. 2), the other end of which is hooked on to a pin 33 fixed to a slide 34.

The slide 34 (which is a constituent part of the unit 2) comprises a central aperture 35, an appendix bent at a right angle 36, a thrust pin 37, and, on the opposite face to the latter, a pair of guide pins 38 disposed in the slots 29 and grooves 28. The slide 34 also comprises a prong 60 on one side, its purpose being described hereinafter.

The plates 21, 24, 25 and the spacer 27 comprise a central bore 38A, 39, 40 and 41. When the unit 2 is mounted, these bores are coaxial with each other, and the aperture 35 in the slide 34 has its longitudinal axis intersecting the axis of said bores.

The unit 2 also comprises a cam 42 with an eccentric appendix 43, the terminal part of which cooperates with the pin 37 to produce the movement of the slide 34 (in the direction of the arrow Z in FIG. 2) when the handles 44 are rotated. The cam 42 comprises a hub extending from the two opposite sides of the appendix 43. The hub is traversed by a square bore 45 into which a square shaft 71 is inserted, the handles 44 being disposed on its ends (see FIG. 5). A portion 46 of the hub comprises a collar 47 disposed in the aperture 35, and having a height substantially equal to the thickness of the slide 34. The portion 46 is disposed in, and supported by the bores 38A, 39 and 41. The other portion, indicated by 48, is disposed in, and supported by the bore 40 of the plate 25. A torsion spring 49 is mounted on the portion 48. An arm 50 of this spring is coupled to the eccentric appendix 43, and tends to urge this appendix into contact with one of the stop columns 30. The other arm is coupled to the other column 30.

The plate 25 is joined to the plate 24 by screws 52, which are screwed into the columns 30, their shanks passing through bores 52A in the plate 25. To enable the appendix 36 and consequently the slide 34 to move, the plate 25 comprises a recess 53. A pair of screws 54 fix a block 55, forming part of the catch mechanism to be described hereinafter, to the inner face of the plate 25.

Figure 3:
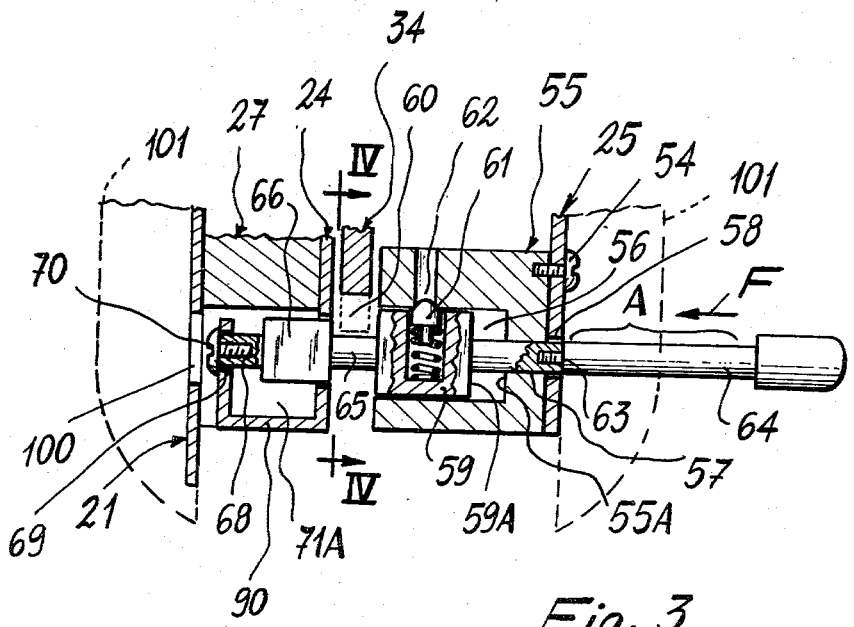
FIG. 3 is a partial section through the lock on the line III—III of FIG. 2 and illustrates the catch mechanism in the position which enables the handle to be operated.

Referring to FIG. 3, the block 55 comprises a square bore 56 communicating with a circular bore 57. The bore 57 is aligned with a corresponding bore 58 in the plate 25. A member 59 of square cross-section can slide in the square bore 56, and has mounted in it a spring stop 61 which, when said member is in a given position, snaps into a bore or seat 62 in the block 55, so fixing this position and making it necessary to exert a certain force in order to displace said member 59. The member 59 comprises on one side a cylindrical extension 63 which traverses the bores 57, 58, and having its end bored and threaded for coupling a screw 70 or rod 64 which is operated by the user in order to block or unblock the lock. On the opposite side, the member 59 is connected by a cylindrical portion 65 to a member 66 having a smaller square cross-section than the member 59. The plate 24 is provided with a square aperture 67 of such a size as to allow the member 66, but not the member 59 to pass. The plate 24 comprises an appendix 90 bent at a right angle, which originates from underneath the square bore 67 and comprises a bore 69 in its vertical arm. The bore 69 is aligned with the square bore 67, and has a diameter substantially equal to a bored and threaded cylindrical appendix 68, which can traverse the bore 69 and forms a single body with the member 66. A bore 100 is provided in the plate 21, aligned with the bores 67, 69, and has a diameter greater than the diameter of the head of the screw 70 when the latter is screwed into the appendix 68. Instead of the screw 70, the rod 64 can be screwed into the appendix 68. The bore 69 has a diameter less than the diameter of the head of the screw 70. For reasons which will be indicated hereinafter, the diameter of the bore 58 is also less than that of the head of the screw 70. Over a certain portion A, the rod 64 has a diameter equal to that of the cylindrical appendices 63 and 68. As can be seen from the drawing, a recess 71A is provided in the spacer disc 27 to enable the described parts to be housed and to move.

Figure 4:
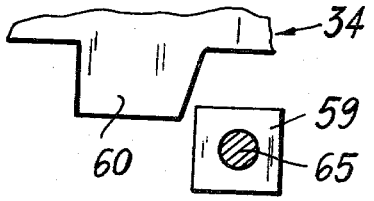
FIG. 4 is a sectional detail on the line IV—IV of FIG. 3.

As can be seen from the drawings, and in particular from FIG. 4, when the cylindrical portion 65 of the catch mechanism is in the trajectory of the prong 60 of the slide 34, the latter can be moved when the handle 44 is rotated, whereas it cannot be moved if one of the members 59 or 66 is located in this trajectory, because the prong 60 would interfere with it.

When the latch unit 1 has been inserted and fixed into the bore 4 in the door 3, the unit 2 is inserted into the bore 22 of the door, such that the raised appendix 36 of the slide 34 becomes inserted between the portion 9 and the transverse portion 15 of the slide 13. This insertion is facilitated by pushing the head 12 with a finger so as to increase the distance between 9 and 15. Pressure or impact is then applied to the plate 21, so that the teeth 23 enter the door material.

To cover the bore 22 and hide the unit 2 from view, a disc 101 is fitted against the door to rotatably support a handle 44 to which the square shaft 71 is rigidly connected. This shaft traverses the bore 45 in the hub 46, 48, and its free end (which projects from the other side of the door) penetrates into a square bore in the other handle 44 which is rotatably supported in its own disc 101, this disc also being fitted to the door. The two discs with their handles, together with the unit 2, are connected together and to the door (see FIG. 5) by screws 300 inserted through bores 301 in one of the discs 101, then passing through the aligned bores A1 of the plates 21, 24, 25 and spacer 27, and screwed into threaded bores 302 in the other disc 101.

Its operation is as follows:

By rotating one of the handles 44, the square shaft 71 is rotated which rotates the cam 42, which in turn bears against the thrust pin 37 of the side 34 and consequently moves the slide 34 (towards the right in FIG. 2-arrow Z) which by means of its appendix 36 causes the head 12 to recede into the tubular portion 8. The movement stops when the end 35A of the aperture 35 comes into contact with the collar 47 of the cam 42. The angular movement of the handle 44 is much less than 90°. The angle is that indicated by "$\alpha$" in FIG. 2. After this, the door 3 can be opened. When the handle is released, the lock parts return to the position of FIG. 2 under the action of the springs 11, 32, 49 until the cam 42 bears against the stop column 30. If it is required to prevent the door from opening, the rod 64 is pushed in the direction of the arrow F (see FIG. 3). The member 59 then stops against the disc 24, and becomes disposed in the trajectory of the prong 60 of the slide 34, so that the handle 44 cannot rotate.

When it is required to release the catch, the rod 64 is pulled. The movement stops when the head of the screw 70 collides against the vertical arm of the right angled appendix 90. In this position, the resilient stop 61 engages in the seat or bore 62, and the cylindrical portion 65 becomes disposed in the plane of the slide 34, and the prong 60 can pass over it as the slide moves.

In case of emergency, when it is necessary to open the door from the outside in spite of the fact that the catch mechanism is in its blocking position, it is necessary only to remove the external handle 44 with its disc 101, and then push the screw 70 (i.e. in the opposite direction to the arrow F).

Figure 2:
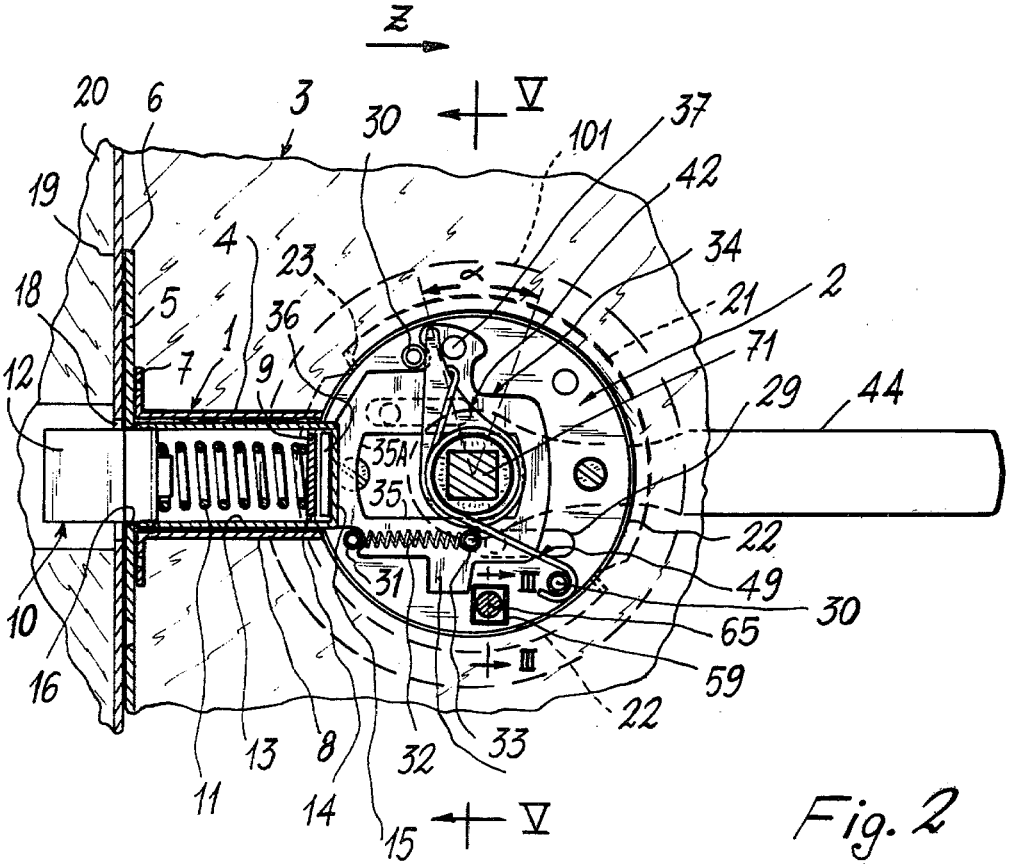
FIG. 2 is a vertical section through a door at the level of the lock, part of which is shown without an end plate and catch mechanism.

If the lock is to be mounted on a door which opens in the opposite direction to the door 3, then it is necessary only to carry out the following steps:

(a) insert the unit 1 such that the bevelled face of the head 12 faces the outside of the room; this means that the unit has to be rotated through 180°, with respect to the position shown in FIG. 2, about an axis perpendicular to the plane of the drawing passing through the longitudinal axis of the unit;

(b) fit the unit 2 such that the plate 21 is on the outside of the door; this means that the unit has to be rotated through 180°, with respect to its position of FIG. 2, about an axis lying in the plane of the drawing and intersecting the longitudinal axis of the square shaft 71;

(c) screw in the screw 70 in place of the rod 64, and the latter in place of the screw.

After these modifications, by pushing the rod 64 in the opposite direction to the arrow F until the face 59A of the member 59 is brought into contact with the end face 55A of the block 55, the member 66 is brought into the trajectory of the prong 60, so that the lock becomes blocked. When the rod 64 is pulled (starting from the blocked position), the head of the screw 70 comes into contact with the plate 25, so preventing any further movement of the rod, and the depressed portion 65 reaches the unblocked position of FIGS. 3 and 4, so that the door can be opened, even from the outside using the handle.

Figure 6:
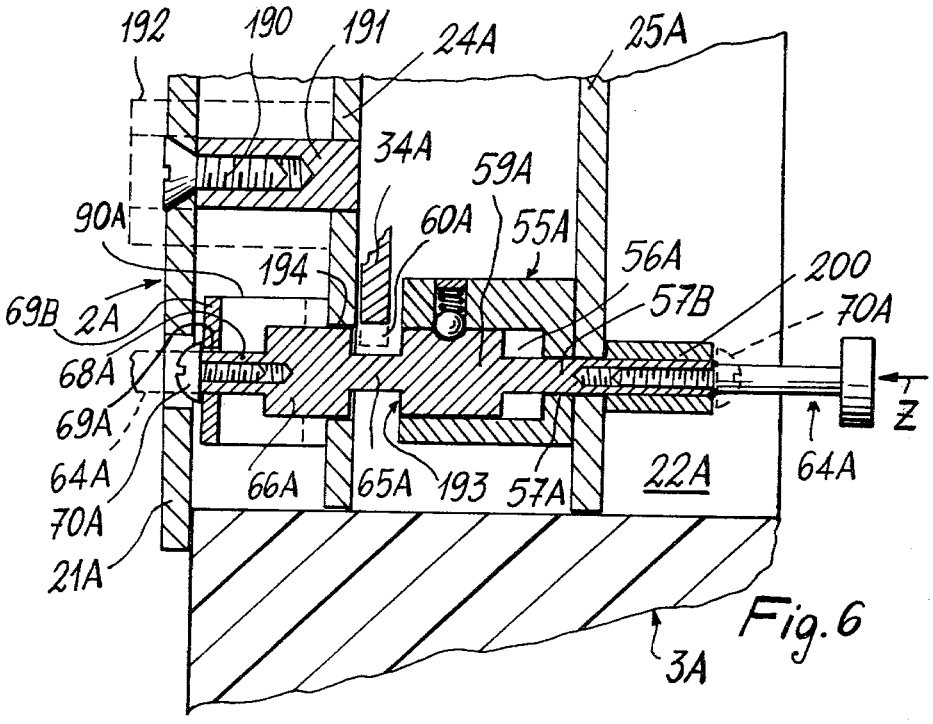
FIG. 6 is a partial vertical section through the lock, showing one modification of the catch mechanism.

A further improved embodiment of the catch mechanism is shown in FIG. 6.

In this figure, the door is indicated by 3A. A unit 2A equivalent to the unit 2 of the previous embodiment is inserted in the transverse bore 22A of the door.

The unit 2A likewise comprises three parallel spaced-apart discs 21A, 24A, 25A. A slide 34A is operated by the door handles, and entrains with it the latch forming part of the unit 1 (not shown here). The disc 21A serves to fix the unit 2A to the door, and is connected to the disc 24A by screws 190 screwed into the threaded bores in spaced columns 191 fixed in any known manner to the disc 24A. If the thickness of the door requires it, the distance between the discs 21A and 24A can be increased by mounting tube portions 192 of greater height on to the columns 191, then resting the disc 21A on these portions and finally screwing the screws 190 into the threaded bores in the columns 191.

The catch mechanism of FIG. 6 comprises a block 55A fixed in any known manner to the disc 25A. The block 55A comprises a square axial bore 56A in the centre of which there opens a circular bore 57A. The catch mechanism comprises a slider 193. The slider 193 comprises two projections or members of equal square cross-section 59A and 66A, an intermediate cylindrical portion 65A and two cylindrical end appendices 68A and 57B. These appendices are provided with a threaded bore. The slider 193 is guided in the bores 56A and 57A of the block 55A.

On that part of the appendix 57B which projects beyond the disc 25A there is mounted a tube portion 200, its axial bore having a diameter less than that of the head of a screw 70A. A bracket 90A is fixed to the plate 24A, for example by welding, and comprises a bore 69A having a diameter less than that of the head of the screw 70A, and aligned with an aperture 194 in the plate 24A. The size of this aperture 194 is such as to allow the projection 66A to pass freely.

If the control rod 64A is screwed into the bore in the appendix 57B, the screw 70A is screwed into the bore in the appendix 68A.

In the position shown in FIG. 6, the intermediate portion 65A of the slider 193 is positioned under the appendix 60A of the slide 34A, and this latter can be moved in order to open the door. If it is required to prevent movement of the slide 34A, and thus prevent the door 3A from opening, the rod 64A is pushed in the direction of the arrow Z. The movement of the slider 193 stops when the projection 66A comes into contact with the transverse portion of the bracket 69B rigid with the disc 24A. In this position, the projection 59A is disposed, without completely leaving the bore 56A, in the trajectory of the appendix 60A of the slide 34A, so that this latter cannot be moved, and consequently the door cannot be opened.

In order to unblock the lock and thus enable the door to be opened, the rod 64A is pulled. The movement of the slider 193 stops when the head of the screw 70A comes into contact with the transverse portion of the bracket 69B. In this position, the intermediate portion 65A is positioned under the appendix 60A of the slide 34A, and this latter can be moved. The control rod 64A is always disposed on that side of the door 3 facing the inside of the room to be closed. In FIG. 6, the room interior is thus on the right hand side. If the room interior is on the left hand side, the control rod 64A is screwed into the appendix 68A and the screw 70A into the appendix 57, as shown by dashed lines. Assuming that the slider 193 is in the position shown, the head of the screw 70A is in contact with the end of the portion 200, and the portion 65A is positioned below the appendix 60A of the slide 34A, so that this latter can be moved and the door opened. If it is required to prevent the door from opening, the rod 64 (positioned on the left hand side of the figure) is pushed in the opposite direction to the arrow Z. The movement of the slider 193 stops when the projection 59A comes into contact with the end of the bore 56A. When this happens, the projection 66A is disposed in the trajectory of the appendix 60A of the slide 34A, so that this latter cannot be moved and the door cannot be opened.

To return the slider 193 into its unblocked position, it is necessary only to reposition the portion 65A under the appendix 60A, which is done by pulling the rod 64A and moving the head of the screw 70A into contact with the end of the portion 200.

Although only one embodiment of the invention with two modifications has been described, it will be easy for an expert of the art, from the inventive idea described herein, to devise numerous modifications, which must however all fall within the scope of the inventive idea itself.

Thus it is apparent that the same lock, although having been designed mainly for handle operation, can be operated by knobs or the like. This universal aspect is a further advantage of the invention.

It is apparent that if the distance between the two plates 21, 24 is always constant, i.e. if it is not required to interpose inserts 27 of different thicknesses, the right angled appendix 90 can be omitted, and the bore 100 be of a size to enable the head of the screw 70 to pass, which will thus strike the plate 21 in one of the limiting positions of the catch mechanism.

What is claimed is:

1. A door lock comprising:

latch means adapted to be mounted in a door or the like, said latch means including a tubular guide and a latch member mounted for reciprocation therein between a latched position and an unlatched position;

a housing assembly adapted to be mounted in a door;

a slide member mounted for reciprocation in said housing assembly and coupled to said latch member, said slide member including a thrust portion fixed thereto;

a single cam member rotatably mounted in said housing assembly having an eccentric portion and a central hub portion having a bore formed therethrough adapted to receive a shaft therein, the axis of said bore being substantially coincident with the axis of rotation of said cam member;

said slide member thrust portion being situated in the path of said cam member eccentric portion so that when said cam member is rotated, said eccentric portion will engage said thrust portion to move said slide member;

stop means fixed within said housing assembly; and first spring means for urging said cam member in a direction such that said eccentric portion normally engages said stop means.

2. The combination of claim 1 further including second spring means for normally urging said slide member thrust portion into engagement with said cam member eccentric portion.

3. The combination of claim 2 wherein said second spring means comprise a spring member forming part of said latch means adapted to normally urge said latch member towards said latched position.

4. The combination of claim 2 wherein said second spring means comprise a spring member, one end of which is fixed to said slide member and the other end of which is fixed to said housing assembly.

5. The combination of claim 1 wherein said first spring means comprise a torsion spring, one end of which is fixed to said housing assembly and the other end of which engages said cam member.

6. The combination of claim 1 wherein said housing assembly comprises a plurality of spaced disc-shaped plate members, one of which has a diameter greater than the diameter of the others, said one plate member having teeth projecting therefrom.

7. The combination of claim 1 wherein said latch member comprises a head member and an associated fork having an end which projects from said tubular guide to form a slot and wherein said slide member has an appendix portion, said appendix portion extending through said slot to couple said slide and latch member.

8. The combination of claim 7 wherein said appendix portion extends substantially perpendicular to the direction of movement of said slide member.

9. The combination of claim 1 wherein said housing assembly comprises a plurality of spaced, disc-shaped plate members, at least one of which includes a pair of parallel slots formed therethrough and wherein said slide member include a pair guide pins fixed thereto situated in said guide slots.

10. The combination of claim 1 wherein said bore formed through said central hub portion of said cam member has a substantially square cross-section adapted to receive a shaft having a corresponding cross-section, and wherein said housing assembly comprises a plurality of spaced, disc-shaped plate members having coaxial bores formed respectively therethrough, said hub portion being supported in said coaxial bores.

11. The combination of claim 1 wherein said slide member is formed with an elongated aperture and wherein said central hub portion of said cam member is situated in said aperture.

12. The combination of claim 1 further including selectively operable catch means for preventing said slide member from moving, said catch means comprising a prong projecting from said slide member and elongate means adapted to be interposed in the path of said prong to prevent opening of the door.

13. The combination of claim 12 wherein said housing assembly includes a pair of spaced, parallel disc-shaped end plate members and an intermediate disc-shaped plate member located between said end plate members; and wherein said elongate means include an elongate member mounted for axial movement in a direction substantially perpendicular to said plate members, said elongate member including a pair of stop portions having different respective transverse dimensions, said stop portions being spaced from each other and interconnected by an intermediate portion having a reduced transverse dimension relative to said stop portions, and a pair of elongate operating portions, each axially extending from an end thereof from a respective one of said stop portions; and further including a guide element fixed to an inwardly facing surface of one of said end plate members and defining an interior bore, the stop portion having the larger transverse dimension being slideably received in said interior bore so that said elongate member is axially slideable; an aperture formed in said intermediate plate member aligned with said guide element interior bore and through which the stop portion having the smaller transverse dimention is adapted to pass, said aperture being smaller than the larger transverse dimension of the other stop portion, control means adapted to be fixed to the free end of either one of said operating portions and stop means adapted to be fixed to the free end of the other one of said operating portions, and wherein said elongate member is situated such that said reduced dimension intermediate portion is normally located in the plane of movement of said slide member and out of the path of movement of said prong, and said elongate member being axially moveable to a position by pushing the control means until one of said stop portions is situated in the path of movement of said prong to obstruct the movement of said slide member.

14. The combination of claim 13 further including resilient detent means provided in said larger stop portion and guide element slideably received therein for releaseably holding said elongate member in the position wherein said intermediate portion is located in the plane of said slide member.

15. The combination of claim 13 wherein said plate members are located such that when one of said stop portions is situated in the path of said prong, a surface of the other stop portion abuts a surface of one of said plate members, and when said intermediate portion is situated in the plane of movement of said slide member, said stop means abuts a surface of one of said plate members.

16. The combination of claim 12 wherein said housing assembly includes a pair of spaced, parallel disc-shaped end plate members and an intermediate disc-shaped plate member located between said end plate members; and wherein said elongate means include an elongate member mounted for axial movement in a direction substantially perpendicular to said plate members, said elongate member including apair of stop portions having substantially the same respective transverse dimensions, said stop portions being spaced from each other and interconnected by an intermediate portion having a reduced transverse dimension relative to said stop portions, and a pair of elongate operating portions, each axially extending from an end thereof from a respective one of said stop portions; and further including a guide element fixed to an inwardly facing surface of one of said end plate members and defining an interior bore, one of said stop portions being slideably received in said interior bore so that said elongate member is axially slideable; an aperture formed in said intermediate plate member aligned with said guide element interior bore and through which the stop portion which is not received in said interior bore is adapted to pass, control means adapted to be fixed to the free end of either one of said operating portions and stop means adapted to be fixed to the free end of the other one of said operating portions, and wherein said elongate member is situated such that said reduced dimension intermediate portion is normally located in the plane of movement of said slide member and out of the path of movement of said prong, and said elongate member being axially moveable to a position by pushing on the control means until one said stop portions is situated in the path of movement of said prong to obstruct the movement of said slide member.

17. The combination of claim 16 wherein said stop means comprise a stop screw having a head and adapted to be threadedly connected to the free end of one of said operating portions, and further including an element fixed to said intermediate plate member and a spacer fixed to an external plate member, said head of said stop screw when attached to one of said operating portions adapted to abut said spacer and when attached to the other of said operating portions adapted to abut said element.

* * * * *